US006562197B2

(12) United States Patent
Forester

(10) Patent No.: US 6,562,197 B2
(45) Date of Patent: May 13, 2003

(54) DRAINAGE HYDROFOIL BLADE

(76) Inventor: Andrew S. Forester, 431 Patricia La., Wrightstown, WI (US) 54180

( * ) Notice: Subject to any disclaimer, the term of this patent is extended or adjusted under 35 U.S.C. 154(b) by 0 days.

(21) Appl. No.: 10/036,263

(22) Filed: Oct. 22, 2001

(65) Prior Publication Data

US 2002/0066546 A1 Jun. 6, 2002

Related U.S. Application Data

(60) Provisional application No. 60/246,902, filed on Nov. 8, 2000.

(51) Int. Cl.[7] ..... D21F 1/54; D21G 9/00
(52) U.S. Cl. ..... 162/352; 162/374
(58) Field of Search ..... 162/351–352, 162/354, 366, 374

(56) References Cited

U.S. PATENT DOCUMENTS 3,432,385 A * 3/1969 Thorp ..... 162/297
3,497,420 A * 2/1970 Clark ..... 162/252
3,738,911 A * 6/1973 Kienzl et al. ..... 162/352
4,055,460 A 10/1977 Buchanan
4,123,322 A * 10/1978 Hoult ..... 162/352
4,532,009 A 7/1985 Nickerson
4,838,996 A * 6/1989 Kallmes ..... 162/352
5,562,807 A 10/1996 Baluha
5,735,330 A * 4/1998 Buchmann et al. ..... 162/352
5,830,322 A * 11/1998 Caram et al. ..... 162/300
5,922,173 A * 7/1999 Neun et al. ..... 162/209
5,951,823 A * 9/1999 Caram et al. ..... 162/351
6,030,501 A * 2/2000 Neun et al. ..... 162/352
6,126,786 A * 10/2000 White et al. ..... 162/352
6,309,511 B1 * 10/2001 Iwata et al. ..... 162/209

* cited by examiner

*Primary Examiner*—Jose A. Fortuna
(74) *Attorney, Agent, or Firm*—Flynn, Thiel, Boutell & Tanis, P.C.

(57) ABSTRACT

A hydrofoil blade having a top surface with a leading edge in contact with a forming fabric and a trailing edge, and a leading side surface disposed transversely to the direction of movement of said fabric upstream of and generally at an acute angle to the top surface thereby draining water from the stock. A plurality of slots extend at an acute angle from the leading side surface to a point between the leading and trailing edges on the top surface to force a portion of the drained water back into the stock, whereby any flocs formed in the stock are dispersed in the transversal shear generated by the drained water.

5 Claims, 2 Drawing Sheets

39
41
34
34
34
34
34
25
32
36
38
37

DRAINAGE HYDROFOIL BLADE

This application claims the benefit of Provisional application Ser. No. 60/246,902, filed Nov. 8, 2000.

FIELD OF THE INVENTION

This invention relates to a device for dispersing flocs in a papermaking process and, more particularly, to a device for dewatering of the sheet in a papermaking process while simultaneously dispersing the flocs.

BACKGROUND OF THE INVENTION

The sheet forming process is composed of three hydrodynamic processes. These processes are drainage, oriented shear, and turbulence. Drainage is characterized as perpendicular flow through a screen (forming fabric) that varies with time. Oriented shear is fluid shear flow having a distinct pattern or direction in the undrained fiber suspension. Turbulence is the random fluctuation in fluid flow sheet forming process, papermakers control drainage, oriented shear and turbulence to alter sheet properties.

The most difficult hydrodynamic process to control is oriented shear, specifically cross-machine direction shear, although oriented shear can exist in the machine direction as well as in the cross-machine direction. Machine direction shear is generated generally by a velocity difference between the headbox jet and the forming fabric (forming wire) speeds. Cross-machine shear is generally generated by machine-direction ridges. That is, during the sheet forming process, a phase shift occurs as these ridges encounter the vacuum pulse of drainage elements. When this occurs, the hills become valleys and vice versa. The movement of stock downward from a ridge into a valley creates the cross-machine shear. One such device for controlling cross-machine shear is disclosed in U.S. Pat. No. 4,532,009. This machine discloses the provision generally of a plurality of notches in the leading or upstream edge of the forming board elements. The center line of these notches extends parallel to the direction of movement of the forming fabric or forming wire. This structure does not effect a satisfactory mixing of the drained water back into the fiber slurry due, it is believed, to the alignment of the longitudinal axes of the notches in a direction parallel to the direction of travel of the forming fabric or forming wire.

Accordingly, it is an object of this invention to provide a hydrofoil blade having elements which generate crosswise streams in the stock on a forming fabric of a papermaking machine.

Another object is to provide a hydrofoil blade, as aforesaid, which has a relatively simple shape and, therefore, is easy to manufacture.

SUMMARY OF THE DISCLOSURE

The objects and purposes of the invention are met by providing a hydrofoil blade having a top surface with a leading edge in contact with a forming fabric and a trailing edge, and a leading side surface disposed transversely to the direction of movement of said fabric upstream of and generally at an acute angle to the top surface thereby draining water from the stock. A plurality of slots extend from the leading side surface to a point between the leading and trailing edges on the top surface to force a portion of the drained water back into the stock, each of the plurality of slots having parallel side walls and a bottom wall of varying depth. The side walls of the slots extend generally perpendicular to the bottom wall and to the top surface of the hydrofoil blade, each of the slots being of a uniform width and having a longitudinal axis that extends at an angle to the leading edge so that the drained water will travel laterally of the longitudinal direction of movement of the fabric into the stock on the fabric, whereby any flocs formed in the stock are dispersed in the transversal shear generated by the drained water.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figure 1:
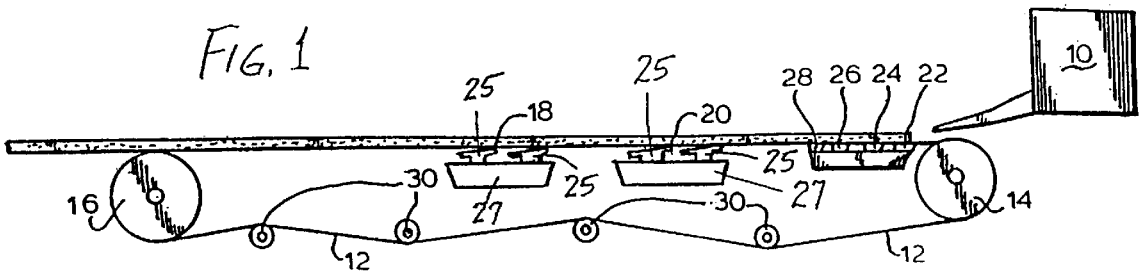
FIG. 1 illustrates a Fourdrinier papermaking machine incorporating the present invention therein.

For illustrative purposes only, the invention will be described in conjunction with a Fourdrinier papermaking machine although the invention can also be used in hybrid formers and gap formers. As shown in FIG. 1, a Fourdrinier machine comprises a headbox 10, a forming fabric 12, and breast and couch rolls 14 and 16. The forming fabric is continuous and travels between the breast and couch rollers. The stock is deposited from the headbox 10 on the top surface 18 of the forming fabric. Immediately following the headbox, the forming fabric is passed over a forming board consisting of several elements 22, 24, 26 and 28. During this stage, some water is drained from the stock and its fibers settle in a thin wet sheet 20 completing the forming of the paper. Following passage over the forming board, the sheet is transported past various other dewatering devices, such as hydrofoil blades 25 in hydrofoil or gravity foil boxes 27 and vacuum boxes. At the couch roll 16, sheet 20 is removed and passed on to the press and dryer sections. The forming fabric is returned by rollers 30 to the breast roll 14.

A hydrofoil blade 25 embodying the invention shall now be described in more detail. It should be understood that while the drawings presented herein show four such hydrofoil blades 25, the present invention is not to be limited to only four blades, but is applicable to any number of such blades.

Figure 2:
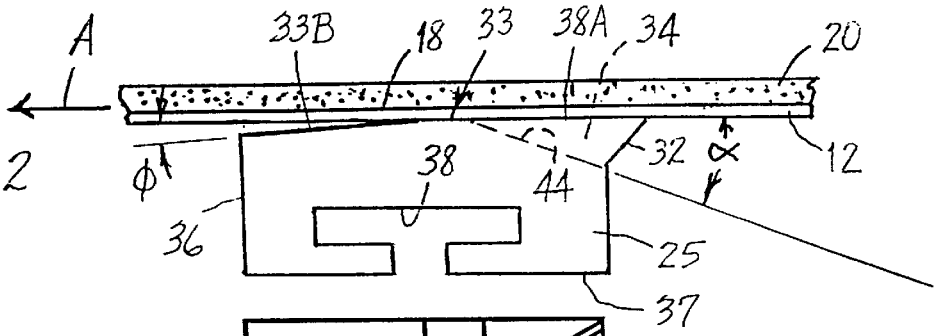
FIG. 2 shows an end view of a hydrofoil blade embodying the invention.

As is obvious from the illustration in FIG. 1, the hydrofoil blades are positioned downstream of the forming board elements 22, 24, 26 and 28. Further, they are positioned transversely to the direction of movement of a longitudinal length of the forming fabric as indicated by the arrow A in FIG. 2. Each blade has, as shown in FIG. 2, a leading or upstream edge 32, a top surface 33, a trailing or downstream edge 36 and a bottom surface 37 having therein a T-shaped slot 38 for facilitating mounting of the hydrofoil blade onto a board or frame member of the papermaking machine. In the illustration in FIG. 2, the leading top surface section 33 is flat whereas the trailing top surface section 33B is inclined at an angle $\phi$ to the horizontal. However, other top surface configurations are within the scope of the present invention. For example, the top surface between the leading edge 32 and the broken line 39 and the surface area between the trailing edge 36 and the broken line 41 can, if desired, be inclined to the horizontal.

Figure 3:
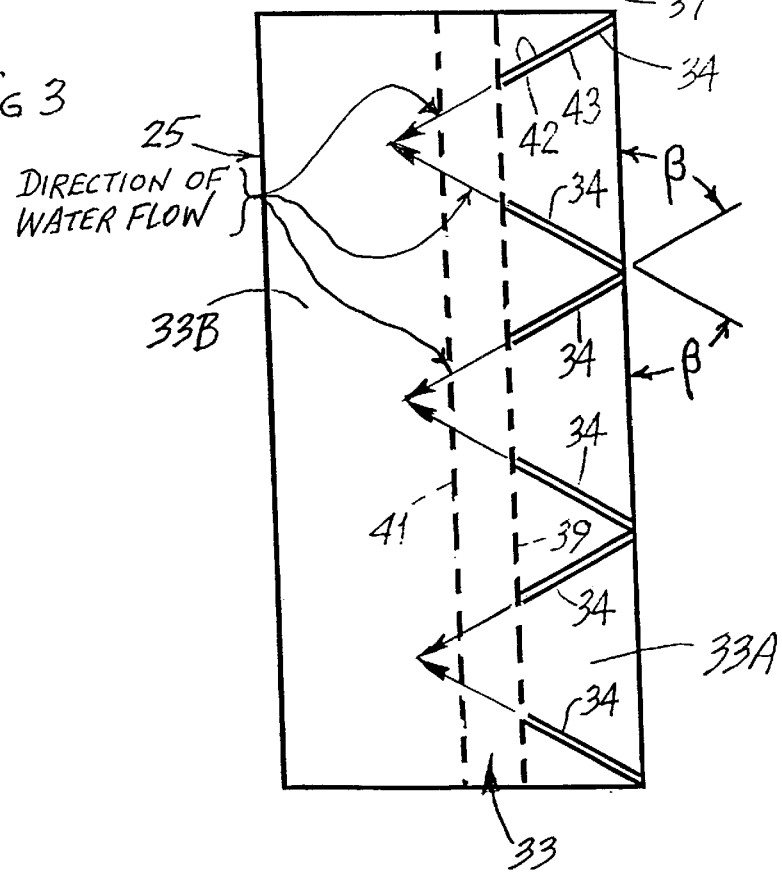
FIG. 3 shows a top view of the hydrofoil blade.

At the leading or upstream edge 32 on each hydrofoil blade, there is provided a plurality of slots 34 having a uniform width along the length thereof but a varying depth represented in FIG. 2 by the angle α extending from the leading edge 32 toward the top surface 33A at a juncture corresponding with the broken line 39 illustrated in FIG. 3. In this particular embodiment, each of the slots 34 extends at an angle β relative to the leading or upstream edge face 32. In this particular embodiment, the angle α is in the range of 10° to 30° and the angle β is in the range of 30° to 70°. The preferred angle for the angle α is 15° whereas the preferred angle for β is 60°. Mutually adjacent slots 34 form a V. It is preferable for the direction A to bisect an angle formed by the V.

Each slot, as stated above, has parallel side walls oriented at the angle β relative to the leading edge face 32. Each of the side walls 42 and 43 is oriented perpendicular to the bottom wall 44 oriented at the angle α relative to the top surface 33.

Figure 4:
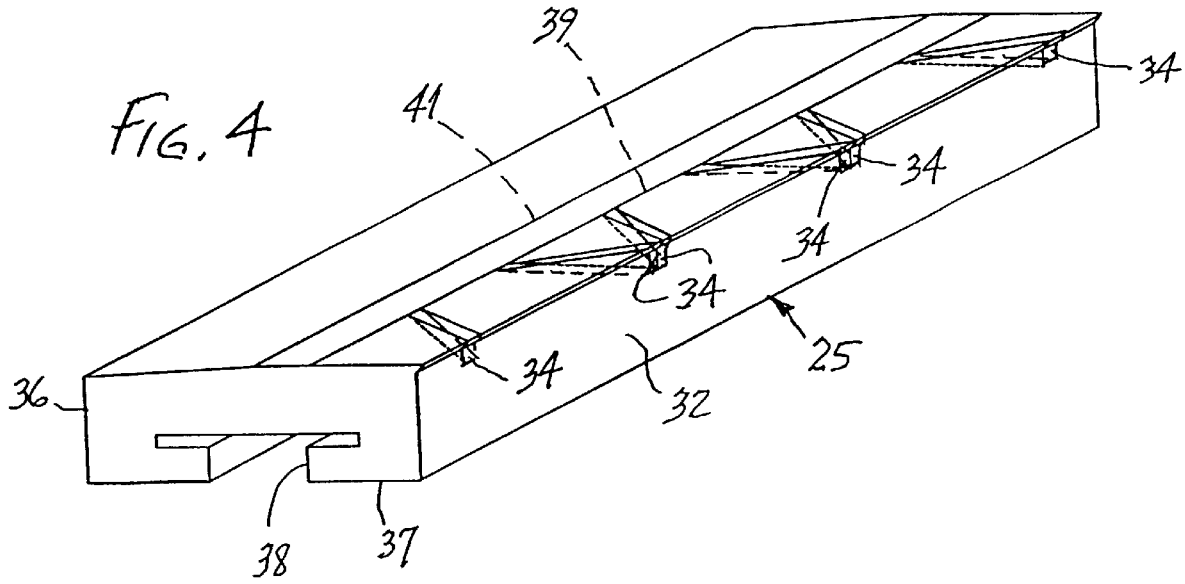
FIG. 4 is an isometric view of the hydrofoil blade.

The lateral spacing between the sets of slots 34 is variable. In the drawing, FIGS. 2, 3 and 4 illustrate a hydrofoil blade 25 that is approximately 20 inches long, it being recognized that hydrofoil blades are usually in the range of 80 to 450 inches long in a working environment.

As the forming fabric 20 travels from the headbox in direction A illustrated in FIG. 2, the water that drains from the stock through the forming fabric at the hydrofoil blades 25 is pushed upwards in the slots back into the stock to cause the water to travel in the stock in a cross-machine direction as well as in a Z-direction perpendicular to the plane of the fabric 20. The shear and pressure pulses align the fibers in the Z-direction and break up fiber flocs. The water also travels at the angle β to create cross-flows in the stock slurry. These cross-flows create cross-machine shear forces that break up fiber flocs and align fibers in the cross-machine direction.

The shear force and the pressure pulses created by the ingoing angle α affect Z-direction strength, compressibility and fines and filler distribution. Z-direction strength will be increased due to the alignment of the fibers. The alignment of the fibers will also increase the compressibility of the sheet in the Z-direction. This will effect improved printing properties, such as ink transfer due to a larger surface area of the sheet being contacted by the printing plate. Pressure pulses will reduce the fiber floc size and create a more uniform floc size distribution, improving formation and reducing basis weight variation. Fines and filler particles that are located near the wire side will be urged upward into the stock slurry creating a more uniform distribution. The Z-directional alignment will also increase bulk. Also, any time water is reintroduced into a sheet, it has the potential to break up the already formed fiber mat and "open up the sheet". This is beneficial for applications where sheet sealing occurs.

The cross-machine shear streams will also break up fiber flocs and create a more uniform floc size distribution. This will improve paper formation and reduce basis weight variation. The cross-machine fiber alignment will also increase cross-machine strength and improve the tensile stiffness orientation. Tensile stiffness orientation is the deviation in maximum tensile strength from the machine direction axis. Having the maximum tensile strength in the machine direction insures the best paper strength and runability. Cross-machine directed fiber alignment also improves paper dimensional stability, reducing paper curl, twist, cockle, and stack lean.

Although a particular preferred embodiment of the invention has been disclosed in detail for illustrative purposes, it will be recognized that variations or modifications of the disclosed apparatus, including the rearrangment of parts, lie within the scope of the present invention.

What is claimed is:

1. A hydrofoil blade for a continuous papermaking apparatus having a forming fabric moving in a continuous loop and means for depositing stock on the forming fabric comprising particles or fibers in suspension with hydrofoil blades disposed transversely and successively under the fabric, the improvement wherein each of said hydrofoil blades has a top surface with a leading top surface section with a leading edge in contact with said forming fabric and a trailing top surface section and a trailing edge, and a leading side surface disposed transversely to the direction of movement of said fabric upstream of and generally at an acute angle to said leading top surface section thereby draining water from said stock, and a plurality of slots extending from said leading side surface to a point between said leading edge and a trailing section of said leading top surface section and are configured to force a portion of the drained water back into the stock, each of said plurality of slots having parallel side walls and a bottom wall of varying depth, said side walls of said slots extending generally perpendicular to said bottom wall and to said leading top surface section of said hydrofoil blade, each of said slots being of a uniform width and having a longitudinal axis that extends at an angle to said leading edge so that said drained water will travel laterally of the longitudinal direction of movement of the forming fabric into the stock on the forming fabric, mutually adjacent slots forming a V, whereby any flocs formed in said stock are dispersed in the transversal shear generated by the drained water.

2. The improvement of claim 1, wherein said slots of adjacent ones of said hydrofoil blades are positioned to phase-shift transversally the tranversely traveling drained water.

3. The improvement of claim 1, wherein a cross-section of each slot is rectangular.

4. The improvement of claim 1, wherein said forming fabric is configured to move in a direction parallel to a longitudinal length thereof; and wherein said direction bisects an angle formed by the V.

5. The improvement of claim 4, wherein the arrangement of slots forming the V are equally spaced in a lateral direction.

* * * * *